US006427803B1

(12) United States Patent
Moore

(10) Patent No.: US 6,427,803 B1
(45) Date of Patent: Aug. 6, 2002

(54) APPARATUS FOR SECURING LADDER TO BUILDING STRUCTURE

(76) Inventor: Scott A. Moore, 29 S. Main St., Dolgeville, NY (US) 13329

( * ) Notice: Subject to any disclaimer, the term of this patent is extended or adjusted under 35 U.S.C. 154(b) by 0 days.

(21) Appl. No.: 09/754,138

(22) Filed: Jan. 5, 2001

(51) Int. Cl.[7] ..... E04G 5/02; E06C 7/06; E06C 7/14

(52) U.S. Cl. ..... 182/107; 182/214; 248/210

(58) Field of Search ..... 182/107, 214, 182/108, 206, 200–203; 248/210, 238

(56) References Cited

U.S. PATENT DOCUMENTS

| | | | | | |
|---|---|---|---|---|---|
| 3,903,991 | A | * | 9/1975 | Phelan | 248/210 X |
| 4,018,301 | A | | 4/1977 | Nameche | 182/206 |
| 4,164,269 | A | * | 8/1979 | Jackson | 182/107 X |
| 4,175,641 | A | * | 11/1979 | Reyes | 182/108 X |
| 4,408,680 | A | * | 10/1983 | Ross | 182/108 X |
| 4,852,689 | A | * | 8/1989 | Erion | 182/204 |
| 4,924,971 | A | * | 5/1990 | Rice | 182/107 X |
| 5,012,895 | A | * | 5/1991 | Santos | 182/214 X |
| 5,078,231 | A | * | 1/1992 | Davis | 182/107 |
| 5,462,133 | A | * | 10/1995 | Merrill, Jr. et al. | 182/172 |
| 5,542,497 | A | * | 8/1996 | Macyszyn | 182/201 |
| 5,868,222 | A | * | 2/1999 | Charbonneau | 182/107 X |
| 5,931,259 | A | * | 8/1999 | Hoey | 182/107 |
| 6,029,774 | A | * | 2/2000 | Cothern | 182/107 |

* cited by examiner

*Primary Examiner*—Daniel P. Stodola
*Assistant Examiner*—Hugh B. Thompson
(74) *Attorney, Agent, or Firm*—Bernhard P. Molldrem, Jr.

(57) ABSTRACT

A ladder safety system for secures the upper end of an extension ladder to the roof, eave, or wall of a building. For each ladder rail there is a rail-mountable bracket member that removably mounts onto the rail, a rigid plate member that removably attaches onto the building, and an adjustable strut or arm. Each of the bracket member and the plate member has an eye or ring affixed onto it, and the strut joins the eye member of the bracket member to the eye member of the plate member. The plate member articulates on the strut to permit it to be oriented to attach to any convenient horizontal, vertical or sloping surface.

16 Claims, 2 Drawing Sheets

APPARATUS FOR SECURING LADDER TO BUILDING STRUCTURE

BACKGROUND OF THE INVENTION

This invention is directed to a system or device for holding a ladder securely in place when the ladder is in use, and which prevents the ladder from tipping or falling. The invention is more specifically concerned with brackets that clamp to the ladder rails at the upper end of the ladder, and which can also be secured to the building structure itself.

Ladder safety has become an important concern, and it has been of special interest to find ways to secure the ladder when it is erected and against a building. More particularly, it has become important to find ways to help prevent the ladder from sliding or from falling when the ladder is in use. For example, in roof construction and when installing shingles on the roof, it is necessary for the workers to climb up and down the ladder many times each day, usually carrying a load. If the ladder slips, the worker can fall and be injured, and this can also result in lost time in construction and an escalation in insurance premiums. For those reasons, it is useful to tie or brace the upper end of the ladder. However, there is currently no convenient means for doing this, especially when the ladder is used in connection with construction of wooden frame structures, such as houses.

Prior ladder support brackets have been fairly cumbersome, and limited to particular types of structure. These could involve a hook or jaw arrangement, which does not lend itself to use when the available surfaces are flat.

OBJECTS AND SUMMARY OF THE INVENTION

Accordingly, it is an object of this invention to provide a simple, sturdy ladder safety device that avoids the drawbacks of the prior art.

It is another object to provide a ladder safety device or devices that attach easily onto the rails of the ladder, and can be attached to wooden building structure using ordinary screw fasteners, nails, or the like.

It is a further object to provide a ladder safety device whose attaching arms or plates can be oriented to attach to a convenient vertical surface or horizontal or sloping surface, at either an upper or lower side thereof.

According to an aspect of the invention, a ladder safety system secures a ladder to a structure, the ladder having the usual pair of parallel ladder rails and ladder rungs between them. There are a pair of ladder securement assemblies that are adapted to be mounted to the rails, respectively, and to the structure. Each of these assemblies is made up of a rail-mountable bracket member adapted to be removably mounted onto one rail, a rigid plate member adapted to be removably mounted onto the building structure, and a rigid strut member joining the rail mountable bracket to the associated plate member. The rigid plate member and the bracket each have an eye or ring member affixed onto it, and the strut has rings or similar elements at its ends so that the plate and bracket are articulated at the ends of the strut member. This permits the strut to be swung and the plate to be oriented to fit against any convenient surface of the building. The plate member has a plurality of openings for receiving removable fasteners, and its eye member is affixed onto a central portion of the plate member. The strut member is provided with means to permit it length to be adjusted, e.g., a turnbuckle.

Preferably, the rail mountable bracket member can take the form of a U-channel member having one open side, and means disposed at said open side for clamping said U-channel member in place over the associated rail. More specifically, the U-channel can have a web and first and second flanges, i.e., inner and outer flanges as installed on the ladder. The associated ring member would be affixed, i.e., welded, to the outer flange. The open end can be secured by bolts passing through openings at the open side, although other clamping devices, i.e., a hinge clamp, could be used instead.

The plate member can be square in shape, with the screw openings at the corners, and optionally along its sides. However, other shapes could be used, such as hexagon or octagon. The plate member need not be flat. While steel is used in the preferred embodiment described below, other metals such as aluminum could be used instead, as well as other materials such a sturdy reinforced plastic.

The above and many other objects, features, and advantages of this invention will become apparent from the ensuing detailed description of a preferred embodiment, which is illustrated in the accompanying Drawing.

DETAILED DESCRIPTION OF A PREFERRED EMBODIMENT

Figure 1:
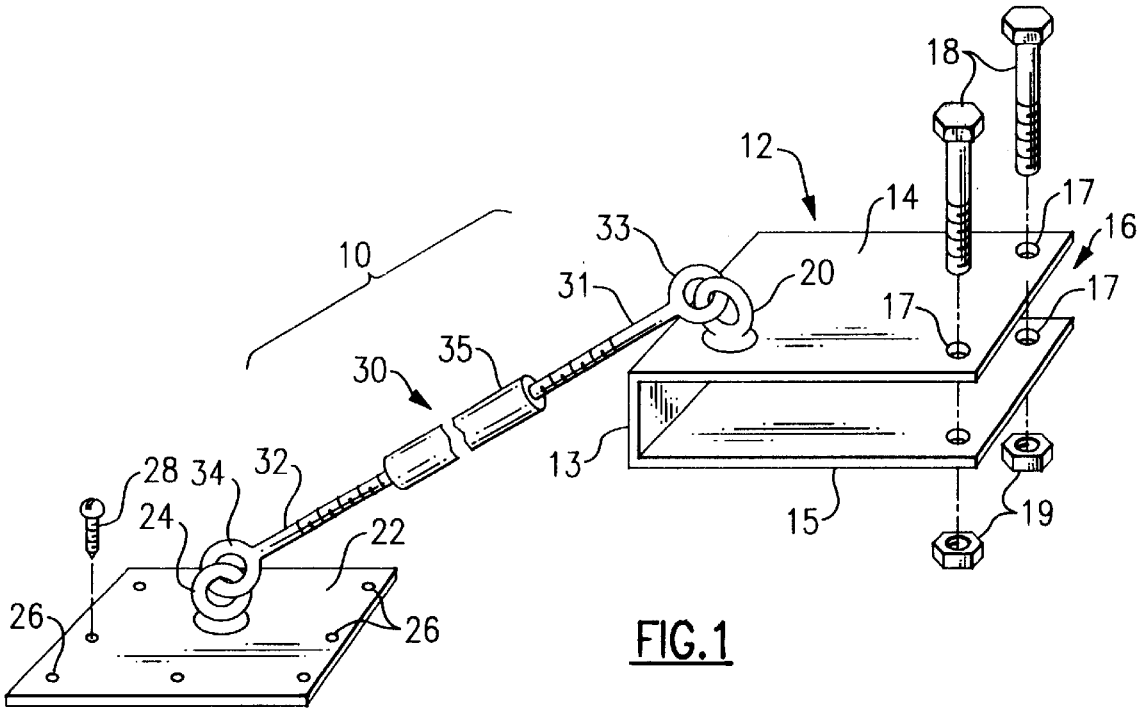
FIG. 1 illustrates a ladder bracket assembly according to a preferred embodiment of this invention.

Now with reference to the Drawing, FIG. 1 shows a ladder bracket assembly 10 of this invention for holding the upper end of a ladder securely in place. There are generally two of these assemblies 10 used with the ladder, one on each rail. A U-channel rail bracket 12 is designed to fit over and clamp onto one of the ladder rails. Here there is a web 13, a first flange 14, a second flange 15, and an open side 16, with bolt holes 17 provided through the flanges 14, 15 adjacent the open side 16. Hex-head bolts 18 are used here, which pass through the holes 17 and are held snugly by nuts 19. Optionally, the bolt holes in one flange or the other could be threaded to receive threads of the bolts 18. A ring or eye 20 is welded onto the flange 14, and this is usually disposed to the outer side of the ladder rail.

A plate member 22 if formed as a square of a mild steel, and has an eye or ring 24 welded or otherwise affixed onto it at its center. There are holes 26 provided at its periphery, here at least at the four comers, and also an additional hole 26 along each edge. These are drilled or punched through and are the proper size to receive a standard threaded fastener, such as a wood screw 28 or similar threaded fastener. Nails can also be used, if desired.

A connecting strut 30 or link member is formed of first and second threaded rods 31 and 32, each having a looped end 33 and 34, respectively. The looped end 33 of the rod 31 passes through the eye member 20 of the bracket 12, and the looped end 34 of the other rod 32 passes through the eye member 24 of the plate 22. A turn buckle 35 is threaded onto the two rods 31, 32 and permits the length of the strut 30 to be adjusted. Optionally, once adjusted the turnbuckle 35 can be set.

The arrangement of the bracket 12, the plate 22, and the strut or link member 30 give the strut 30 two degrees of rotational freedom at the rail bracket 12 and also at the plate 22. This allows the plate to be positioned and oriented in any direction and to attach to any convenient vertical, horizontal, sloping or angled surface. For example, the plate 22 can be attached to a wall, to a roof upper surface, or to a cornice, i.e. to the front fascia or to a bottom soffit surface. The plate can be used with unfinished construction as well and can be secured to any convenient wall, timber, or joist.

If the system of this invention is used on an exposed outer surface, the wood screws or fasteners leave no permanent damage. When the plate member is removed, the resulting screw holes can be easily filled and painted over, and will not be noticeable.

Figure 2:
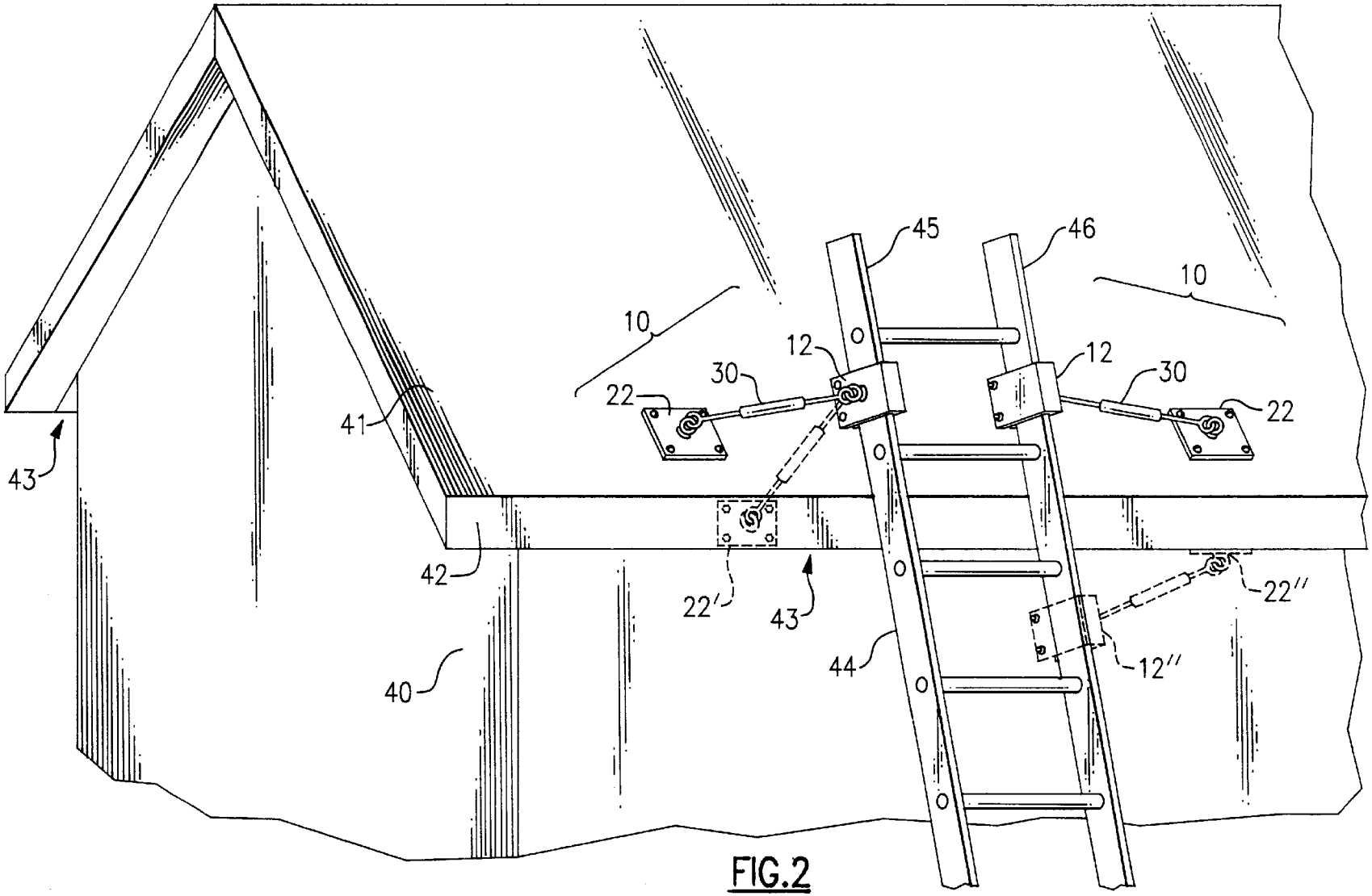
FIG. 2 is a perspective view showing the bracket assemblies of this embodiment used to secure a ladder to a building structure.

FIG. 2 shows the ladder bracket assemblies 10 of this invention being used to support a ladder 44 against a house or similar building structure 40. Here, the building has a roof top 41, and a cornice under the roof eaves with a fascia board 42 and a downward-facing soffit 43. The ladder has left and right ladder rails 44, 46, and two ladder bracket assemblies 10 are shown, with the associated rail brackets 12 mounted one on the left rails 45 and one on the right rail 46. The brackets 12 are U-channel members having one open side that fits over the ladder rail 44 or 46 from the front side such that the open side is oriented in the direction of the back of the ladder, i.e., towards the building structure 40. As shown in solid lines, the plate members 22 can be mounted onto the roof top 41, and then the turnbuckles can be rotated to keep the ladder held snugly in place. Alternatively as shown in ghost lines, the strut can be swung down to permit the plate 22' to attach to the fascia board 42. As another alternative, as shown on the right rail 46, the plate 22" can be positioned against the lower surface of soffit 43. In this case, the associated rail bracket 12" can be positioned a few rungs down from the solid line position.

The system as illustrated and described here holds the top end of the ladder 44 securely to the building 40, and the ladder will not tip or fall. The ladder bracket assemblies 10 can be installed and removed with standard tools in only a few minutes. These do not require permanent attachment to the ladder, and can be moved from one ladder to another.

Figure 3:
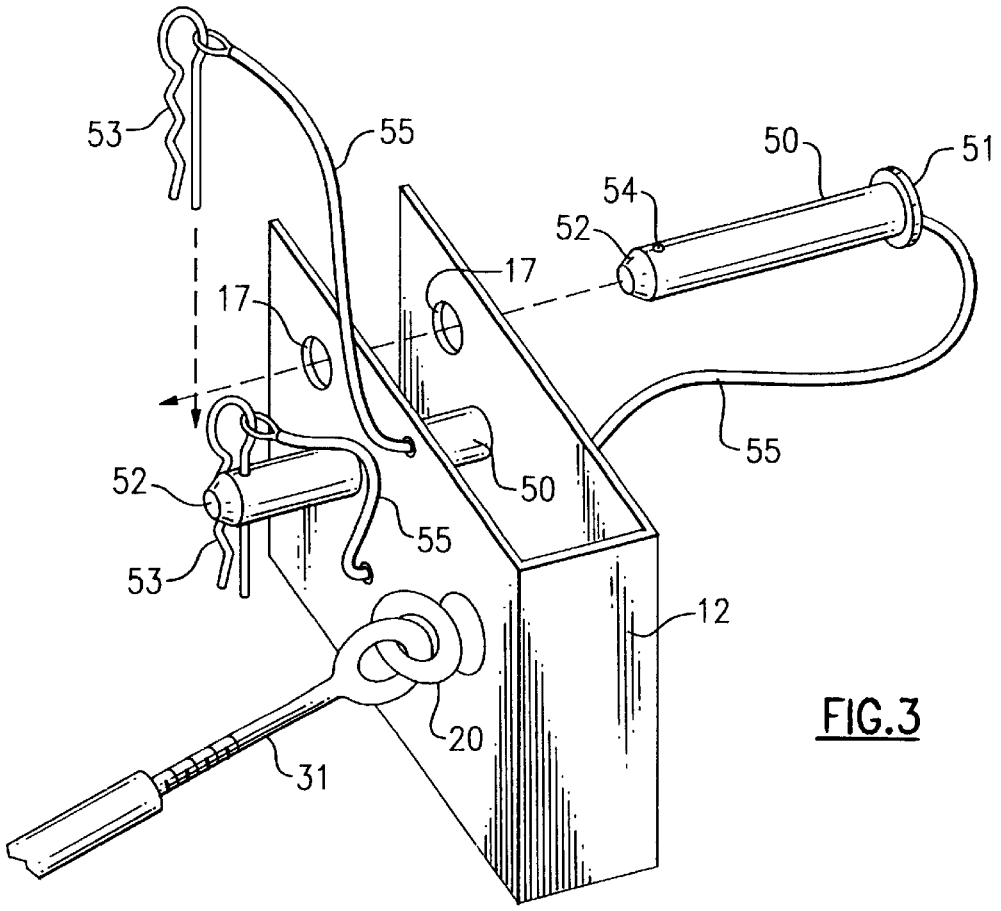
FIG. 3 is a perspective view of a portion of an alternative embodiment of the invention.

FIG. 3 shows an alternative embodiment in which the U-channel bracket 12 is secured with pins 50 rather than the bolts 18 of the prior embodiment. The pins 50 each have a back flange 51 and a nose end 52 that penetrates the holes 17 in the flanges of the U-channel bracket. Removable safety clips 53 lodge into holes 54 at the nose ends 52 of the pins 50. The safety clips are attached by flexible cables 55 to the outer flange 14 of the bracket to prevent loss of the safety clips. Similar flexible cables 55 are attached to the back flange ends of the pins 50. This arrangement of pins and clips provides a quick and simple means of attachment of the U-channel bracket to the ladder. The U-channel bracket slides over the ladder rails and then the pins 50 slide through the holes 17. The safety clips 53 are positioned through the pins 50 to prevent them from coming out.

While the invention has been described hereinabove with reference to a preferred embodiment and various alternatives thereto, it should be apparent that the invention is not limited to such embodiment(s). Rather, many variations would be apparent to persons of skill in the art without departing from the scope and spirit of this invention, as defined in the appended Claims.

I claim:

1. Ladder safety system for securing a ladder to a structure, the ladder haying a pair of parallel ladder rails; comprising a rail-mountable bracket member adapted to be removably mounted onto one of said ladder rails, and having an eye member affixed thereon; a rigid plate member adapted to be removably mountable onto said structure, said plate member having a plurality of openings for receiving removable fasteners therethrough, and including an eye member affixed onto a central portion thereof; and a rigid link arm non-removably articulated at its ends to the bracket member and to the plate member, said link arm joining the eye member of the rail mountable bracket member to the eye member of the plate member.

2. The ladder safety system according to claim 1 wherein said rigid link arm is adjustable in its length direction.

3. The ladder safety system according to claim 2 wherein said rigid link arm includes a turn buckle.

4. The ladder safety system according to claim 1 wherein said rigid link arm has closed ring-eye ends that are non-removably articulated onto the eye members of said bracket member and said plate member.

5. The ladder safety system according to claim 4 wherein the ends of said rigid link arm permit sufficient articulation relative to the plate member and the bracket member such that the plate member may be installed on an upward-facing or downward facing surface, or on a vertical surface of the structure.

6. Ladder safety system for securing a ladder to a structure, the ladder having a pair of parallel ladder rails, the system being comprised of a pair of ladder securement assemblies that are adapted to be mounted to said rails, respectively, and to said structure; each said assembly comprising a rail-mountable bracket member adapted to be removably mounted onto one of said rails, and having an articulation connection member affixed thereon; a rigid plate member adapted to be removably mounted onto said structure, said plate member having a plurality of openings therein for receiving removable fasteners therethrough, and including an articulation connection member affixed onto a central portion thereof, and a rigid strut member non-removably articulated at its ends to the articulation connection members of the bracket member and the plate member, said strut member joining the articulation connection member of the rail mountable bracket to the articulation connection member of the associated plate member.

7. The ladder safety system according to claim 6 wherein each said rail mountable bracket member includes a U-channel member having one open side, and means disposed at said open side for clamping said U-channel member in place over the associated rail, said U-channel member having a pair of side flanges, with said articulation connection member being affixed onto one of said side flanges.

8. The ladder safety system according to claim 7 wherein said U-channel member includes openings adjacent said open side, and a plurality of pin members that penetrate said openings.

9. The ladder safety system according to claim 8 further comprising safety clip members that attach to nose ends of said pins to prevent the pins from being withdrawn through said openings.

10. Ladder safety system according to claim 8 wherein said U-shaped channel member has an open side fitting over the associated rail and facing in a direction behind the ladder.

11. The ladder safety system according to claim 6 wherein each said plate member has four or more of said openings.

12. The ladder safety system according to claim 11 wherein each said plate member is rectangular and has one of said openings situated at each corner thereof.

13. The ladder safety system according to claim 6 wherein the articulation connection member of said rigid plate member is welded to said plate member.

14. The ladder safety system according to claim 13 wherein said rail-mounted bracket member includes a U-channel member having a web and inner and outer flanges, and the associated articulation connection member is welded onto one of said flanges.

15. The ladder safety system according to claim 14 wherein said articulation connection member is welded onto said outer flange.

16. The ladder safety system according to claim 6 wherein said rigid strut member includes means for adjusting the length thereof.

* * * * *